US008390405B2

(12) United States Patent
Shin

(10) Patent No.: US 8,390,405 B2
(45) Date of Patent: Mar. 5, 2013

(54) CIRCUIT BREAKER

(75) Inventor: Seung Pil Shin, Chungcheongbuk-Do (KR)

(73) Assignee: LS Industrial Systems Co., Ltd., Anyang, Gyeonggi-Do (KR)

( * ) Notice: Subject to any disclaimer, the term of this patent is extended or adjusted under 35 U.S.C. 154(b) by 118 days.

(21) Appl. No.: 13/004,841

(22) Filed: Jan. 11, 2011

(65) Prior Publication Data

US 2011/0174600 A1 Jul. 21, 2011

(30) Foreign Application Priority Data

Jan. 18, 2010 (KR) ..... 10-2010-0004491

(51) Int. Cl.
*H01H 75/00* (2006.01)
*H01H 77/00* (2006.01)
*H01H 83/00* (2006.01)

(52) U.S. Cl. ..... 335/15; 335/8; 335/16; 335/21; 335/22; 335/107; 335/133; 335/165; 335/166; 335/171; 335/172; 335/176; 335/190; 335/192; 335/194

(58) Field of Classification Search ..... 200/318; 335/15, 171, 6–8, 10, 14, 16, 21–22, 102–103, 335/106–107, 133, 165–168, 172–176, 185, 335/190, 192, 194
See application file for complete search history.

(56) References Cited

U.S. PATENT DOCUMENTS

| | | | | |
|---|---|---|---|---|
| 3,317,866 | A * | 5/1967 | Hanafusa | 335/16 |
| 4,129,762 | A * | 12/1978 | Bruchet | 200/401 |
| 4,245,203 | A * | 1/1981 | Wafer et al. | 335/16 |
| 4,539,538 | A * | 9/1985 | Flick et al. | 335/16 |
| 4,642,431 | A * | 2/1987 | Tedesco et al. | 200/401 |
| 5,184,099 | A * | 2/1993 | DiMarco et al. | 335/16 |

FOREIGN PATENT DOCUMENTS

| | | |
|---|---|---|
| JP | 63-26948 | 2/1988 |
| JP | 5-274988 | 10/1993 |

OTHER PUBLICATIONS

Japan Patent Office Application Serial No. 2011-006133, Office Action dated Nov. 13, 2012, 2 pages.

* cited by examiner

*Primary Examiner* — Mohamad Musleh
(74) *Attorney, Agent, or Firm* — Lee, Hong, Degerman, Kang & Waimey

(57) ABSTRACT

A circuit breaker comprises a latching plate rotatably coupled to a moveable plate, and tensile type latching springs, each latching spring having two ends fixed to the latching plate and the moveable plate, respectively. Time taken for a moveable contact to be lifted up from a contact time point between the moveable contact and a fixed contact may be shortened, and thus a time duration for which an accident current flows may be reduced. Accordingly, the amount of energy applied to the circuit breaker may be reduced, and a breaking function of the circuit breaker may be enhanced. Furthermore, since a contact pressure between the moveable contact and the fixed contact has a constant change, a reliability on a conductive state of the moveable contact and the fixed contact may be enhanced.

11 Claims, 9 Drawing Sheets

CIRCUIT BREAKER

CROSS-REFERENCE TO A RELATED APPLICATION

Pursuant to 35 U.S.C. §119(a), this application claims the benefit of earlier filing date and right of priority to Korean Application No. 10-2010-0004491, filed on Jan. 18, 2010, the content of which is incorporated by reference herein in its entirety.

BACKGROUND OF THE INVENTION

1. Field of the Invention

The present invention relates to a circuit breaker capable of performing a breaking operation for line protection or for opening and closing a load, or when an overload and a short circuit have occurred, and particularly, to a circuit breaker having a shaft unit, the circuit breaker capable of minimizing damages due to an accident current by rapidly performing a tripping operation when an accident current has occurred.

2. Background of the Invention

Generally, a circuit breaker normally maintains a conductive status when a rated current flows, but performs a breaking operation when an accident current occurs. More concretely, a fixed contact and a moveable contact maintain a closed status when a normal current flows. However, when an accident current has occurred, the fixed contact and the moveable contact are separated from each other to break the accident current as a trip unit detects the accident current and transmits a signal to a switching mechanism. Then, the switching mechanism is released.

Here, it takes several minutes for the switching mechanism to be released. The shorter the time, the more a breaking function of the circuit breaker is maximized. While the accident current is applied to the fixed contact and the moveable contact, an electromagnetic repulsive force is generated between the fixed contact and the moveable contact. As a result, the fixed contact and the moveable contact are separated from each other.

Once the moveable contact has been separated from the fixed contact by the electromagnetic repulsive force, the trip unit detects the accident current to limit the accident current before the switching mechanism is released. This may reduce the amount of energy applied to the circuit breaker to prevent damages of the circuit breaker, thereby maximizing a breaking function of the circuit breaker.

FIG. 1 is a sectional view of a circuit breaker having a shaft assembly in accordance with the conventional art, and FIG. 2 is a disassembled perspective view of a latch unit and a moveable plate unit of the shaft assembly in FIG. 1.

As shown, the conventional circuit breaker comprises a trip unit 1 configured to detect an accident current, a switching mechanism 2 configured to separate a moveable contact 21*a* from a fixed contact 5*a* by receiving a signal indicating the occurrence of an accident current from the trip unit 1, and a shaft assembly 3 configured to perform a closing or tripping operation by the switching mechanism 2.

The shaft assembly 3 includes a shaft 10, a moveable plate unit 20 having the moveable contact 21*a* detachably mounted to the fixed contact 5*a* fixed to the circuit breaker, and rotatably coupled to the shaft 10, and a latch unit 30 disposed between the shaft 10 and the moveable plate unit 20 so that the moveable plate unit can maintain a closed or tripped status.

The moveable plate unit 20 consists of a moveable plate 21 having the moveable contact 21*a* welded at one end thereof, and having a pin forcibly inserted at another end thereof, a connecting plate 22 coupled to the shaft 10 and having the moveable plate 21 rotatably coupled thereto, a connecting pin 23 configured to couple the moveable plate 21 and the connecting plate 22 to each other, connecting springs 24 configured to generate a contact pressure by pushing the moveable plate 21 and the connecting plate 22 from two sides, and washers 25 configured to prevent separation of the connecting springs 24.

The latch unit 30 consists of a limit latch 31 supported by the shaft 10 and the moveable plate 21, a latch spring 32 implemented as a compression spring so as to elastically support the limit latch 31, and a limit pin 33 penetratingly formed at the shaft 10 and the limit latch 31 and configured to rotatably support the limit latch 31 by the shaft 10.

Unexplained reference numeral 5 denotes a fixed plate, 11 denotes a pin groove, and 21*b* denotes a moveable plate pin.

The operation of the conventional shaft assembly will be explained.

As shown in FIG. 3, a compression force of the limit spring 32 assembled to the shaft 10 is transmitted to a moveable plate pin 21*b* forcibly inserted into the moveable plate 21 through the limit latch 31. As a result, the moveable plate 21 maintains an OFF status.

As shown in FIG. 4, when the circuit breaker is in a closed (ON) status by the switching mechanism 2, the shaft assembly 3 is rotated to allow the moveable contact 21*a* of the moveable plate 21 to come in contact with the fixed contact 5*a* of the fixed plate 5. Here, the compression force of the limit spring 32 is transmitted to the moveable plate pin 21*b* forcibly inserted into the moveable plate 21 through the limit latch 31. As a result, a contact pressure is generated between the fixed contact 5*a* and the moveable contact 21*a*.

As shown in FIG. 5, in the occurrence of an accident current, a contact repulsive force is generated between the fixed contact 5*a* of the fixed plate 5 and the moveable contact 21*a* of the moveable plate 21. As a result, the moveable plate 21 is lifted up. Here, the moveable plate pin 21*b* moves along an operation surface (outer surface) of the limit latch 31, which is located on positions different from the operation surface of the limit latch 31 shown in FIGS. 3 and 4. Then, the compression force of the limit spring 32 assembled to the shaft 10 is transmitted to the moveable plate pin 21*b* forcibly inserted into the moveable plate 21 through the limit latch 31. As a result, the moveable plate 21 is lifted up (current limiting status).

However, the conventional shaft assembly consecutively operated as shown in FIGS. 3 to 5 may have the following problems.

Referring to FIG. 6, a contact pressure generated between the fixed contact 5*a* of the fixed plate 5 and the moveable contact 21*a* of the moveable plate 21 will be explained. It takes about 17 seconds for the moveable contact 21*a* to be lifted up from a contact time point between the fixed contact 5*a* and the moveable contact 21*a*. A contact pressure when the circuit breaker in an 'ON' state is in the range of 2.5~2.7. More concretely, it takes a long time from the contact time point between the fixed contact 5*a* and the moveable contact 21*a* to the time point when the moveable contact 21 is lifted up. This may cause a time duration for which an accident current flows to be long. Accordingly, the amount of energy applied to the circuit breaker is increased to degrade a breaking function of the circuit breaker. Furthermore, reliability on a conductive state between the fixed contact 5*a* and the moveable contact 21*a* may be lowered due to a large change of the contact pressure.

SUMMARY OF THE INVENTION

Therefore, an object of the present invention is to provide a circuit breaker capable of having a maximized breaking function by reducing the amount of energy applied thereto, and capable of reducing a time duration for which an accident current flows by rapidly generating an electromagnetic repulsive force between a moveable contact and a fixed contact.

To achieve these and other advantages and in accordance with the purpose of the present invention, as embodied and broadly described herein, there is provided a circuit breaker, comprising: a trip unit configured to detect an accident current; a switching mechanism configured to separate a moveable contact from a fixed contact by receiving a signal indicating the occurrence of an accident current from the trip unit; a shaft rotated by the switching mechanism; a connecting plate fixedly-coupled to the shaft; a moveable plate rotatably coupled to the connecting plate, and having the moveable contact contacting or separated from the fixed contact; a latching plate rotatably coupled to the moveable plate; and a latching spring formed as an elastic spring so as to receive an elastic force in a direction that the moveable contact is spacing from the fixed contact, and having both ends fixed to the latching plate and the moveable plate, respectively.

According to another aspect of the present invention, there is provided a circuit breaker, comprising: a trip unit configured to detect an accident current; a switching mechanism configured to separate a moveable contact from a fixed contact by receiving a signal indicating the occurrence of an accident current from the trip unit; a shaft rotated by the switching mechanism; a moveable plate rotatably coupled to the shaft, and having the moveable contact contacting or separated from the fixed contact; a latching plate rotatably coupled to the moveable plate; and a latching spring formed as an elastic spring so as to receive an elastic force in a direction that the moveable contact is spacing from the fixed contact, and having both ends fixed to the latching plate and the moveable plate, respectively, wherein a first latching pin for fixing one end of the latching spring is coupled to one end of the latching plate, a second latching pin for fixing another end of the latching spring is coupled to one end of the moveable plate, a latching pin hole for inserting the first latching pin is formed at the latching plate, and the latching pin hole is positioned farther than a rotation center of the moveable plate based on the moveable contact.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

For the sake of brief description with reference to the drawings, the same or equivalent components will be provided with the same reference numbers, and description thereof will not be repeated.

Hereinafter, a circuit breaker according to the present invention will be explained in more detail with reference to the attached drawings.

Figure 1:
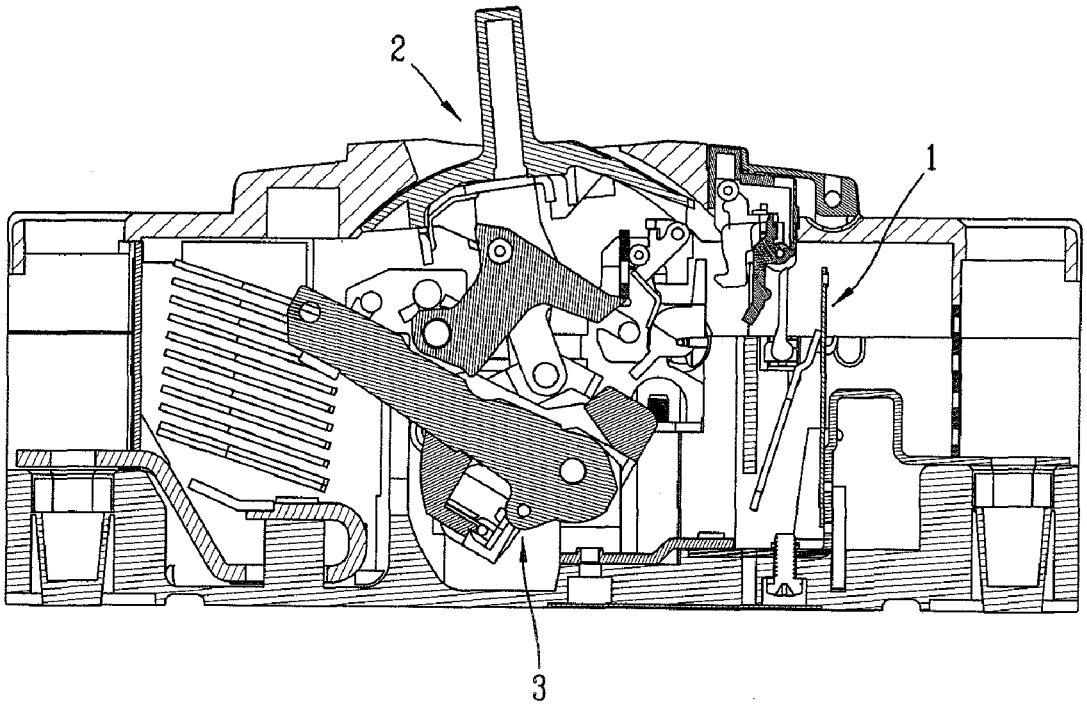
FIG. 1 RELATED ART
FIG. 1 is a sectional view of a circuit breaker having a shaft assembly in accordance with the conventional art.
Figure 2:
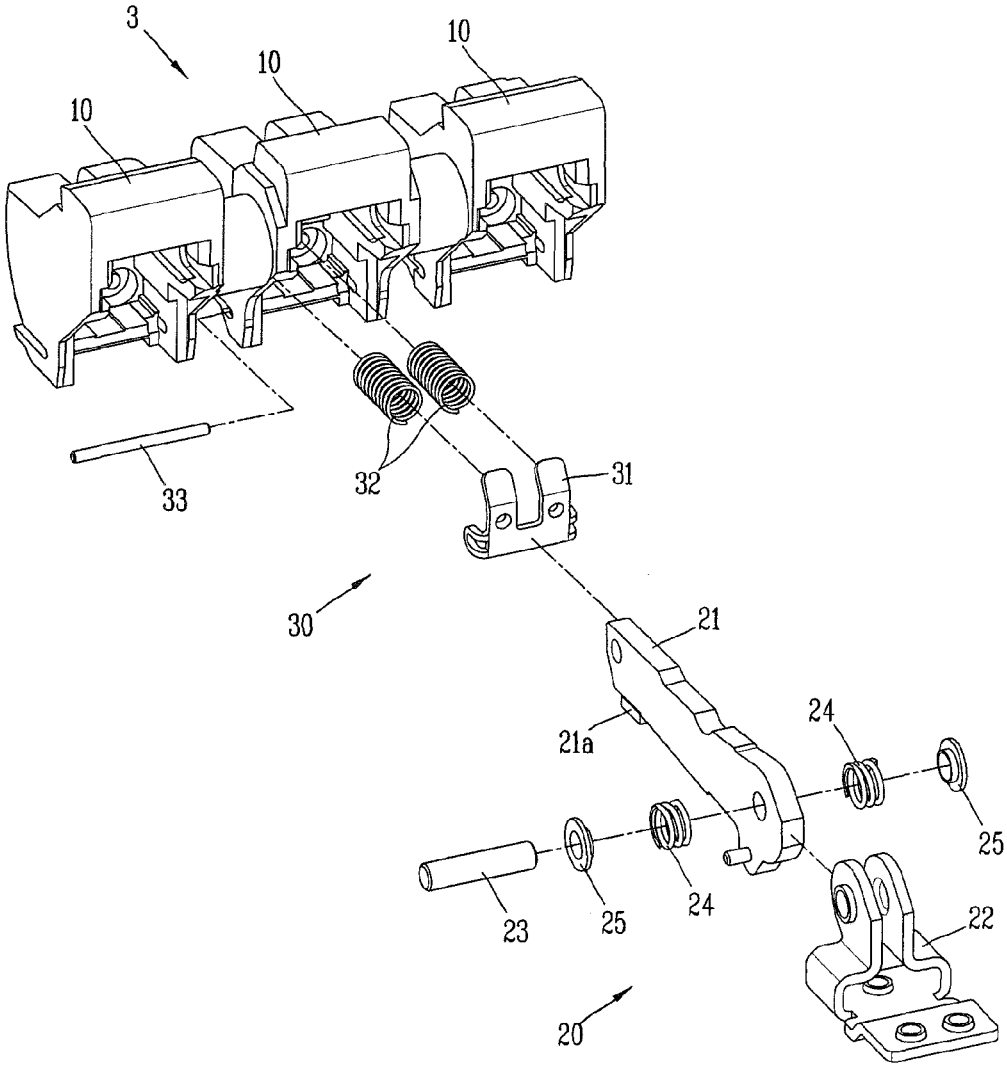
FIG. 2 RELATED ART
FIG. 2 is a disassembled perspective view of a latch unit and a moveable plate unit of the shaft assembly in FIG. 1.
Figure 3:
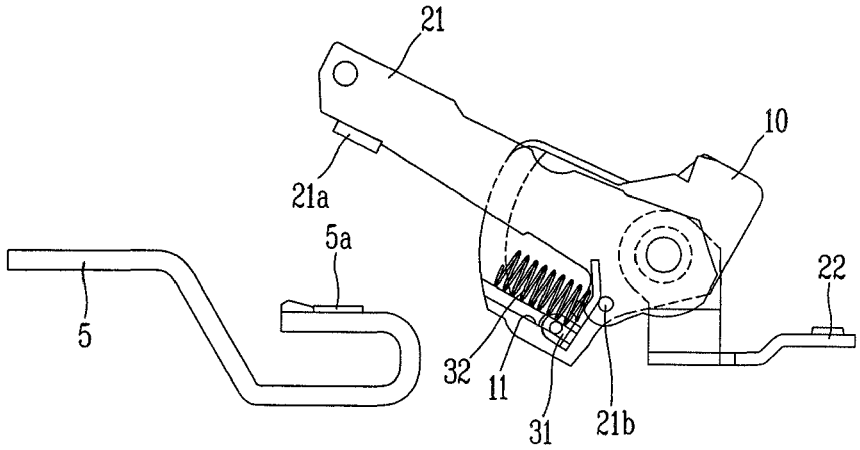
FIG. 3 RELATED ART
FIGS. 3 to 5 are schematic views showing operations of the shaft assembly according to each status in accordance with the conventional art.
Figure 4:
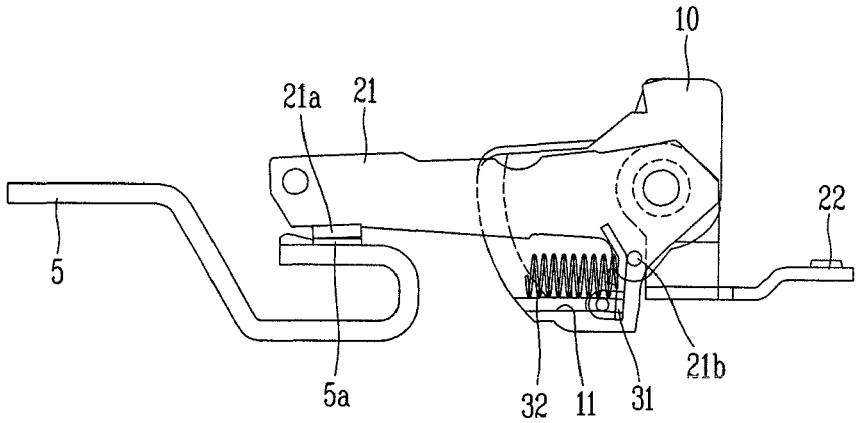
FIG. 4 RELATED ART
Figure 5:
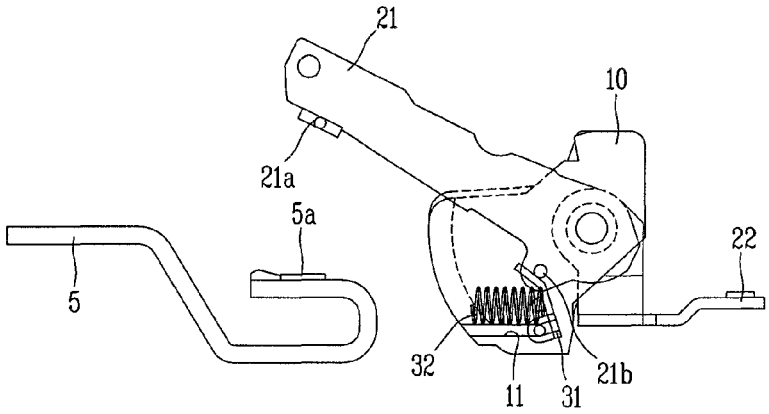
FIG. 5 RELATED ART
Figure 6:
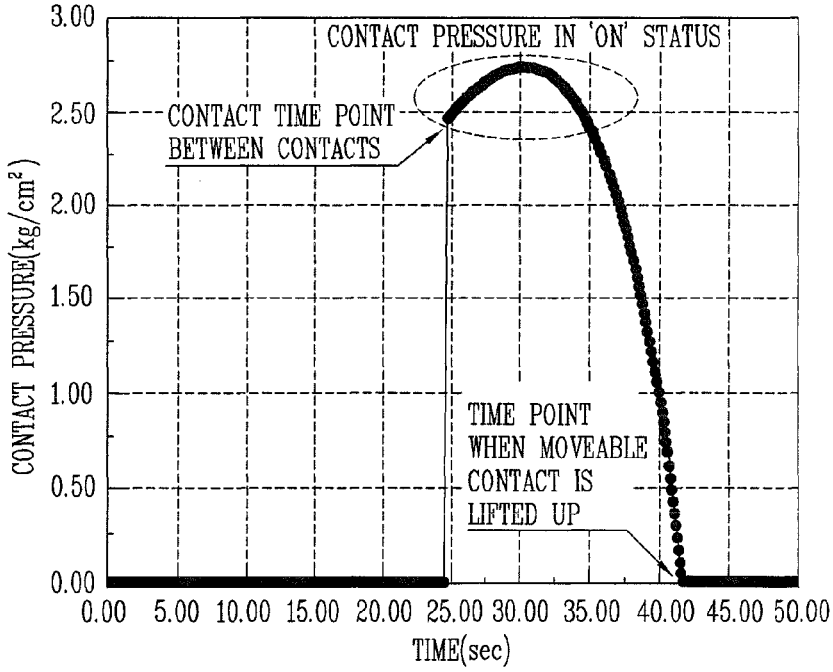
FIG. 6 RELATED ART
FIG. 6 is a graph showing changes of a contact pressure generated between a fixed contact and a moveable contact in FIGS. 3 to 5.
Figure 7:
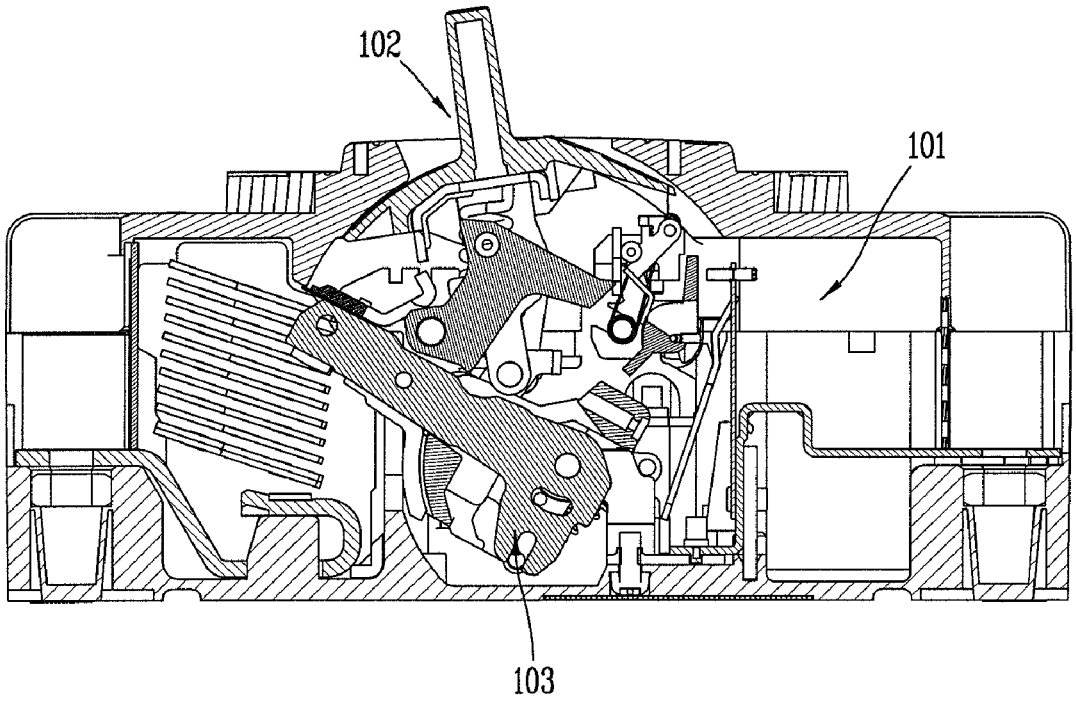
FIG. 7 is a sectional view of a circuit breaker having a shaft assembly according to the present invention.
Figure 8:
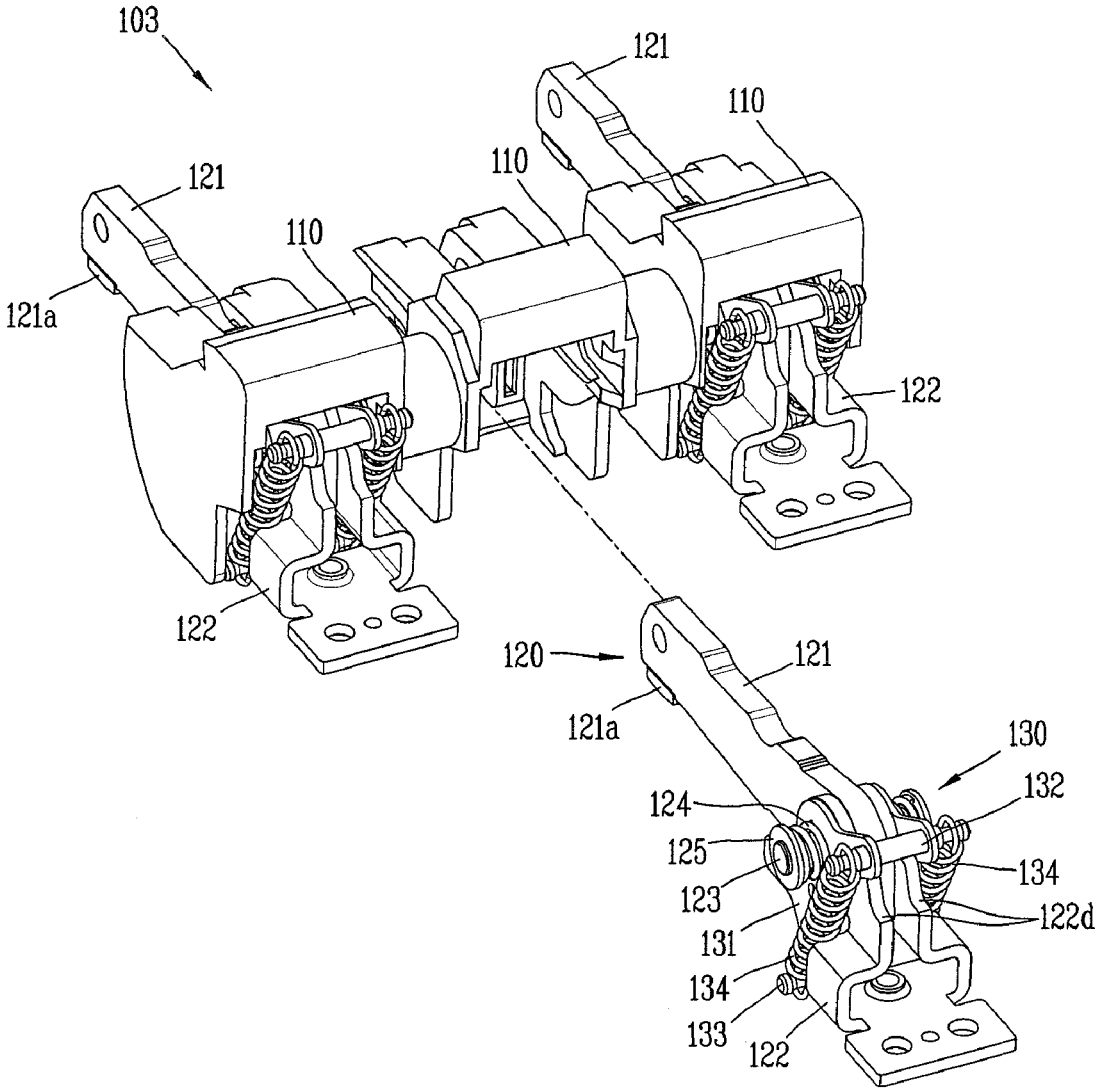
FIG. 8 is a perspective view of the shaft assembly of FIG. 7.
Figure 9:
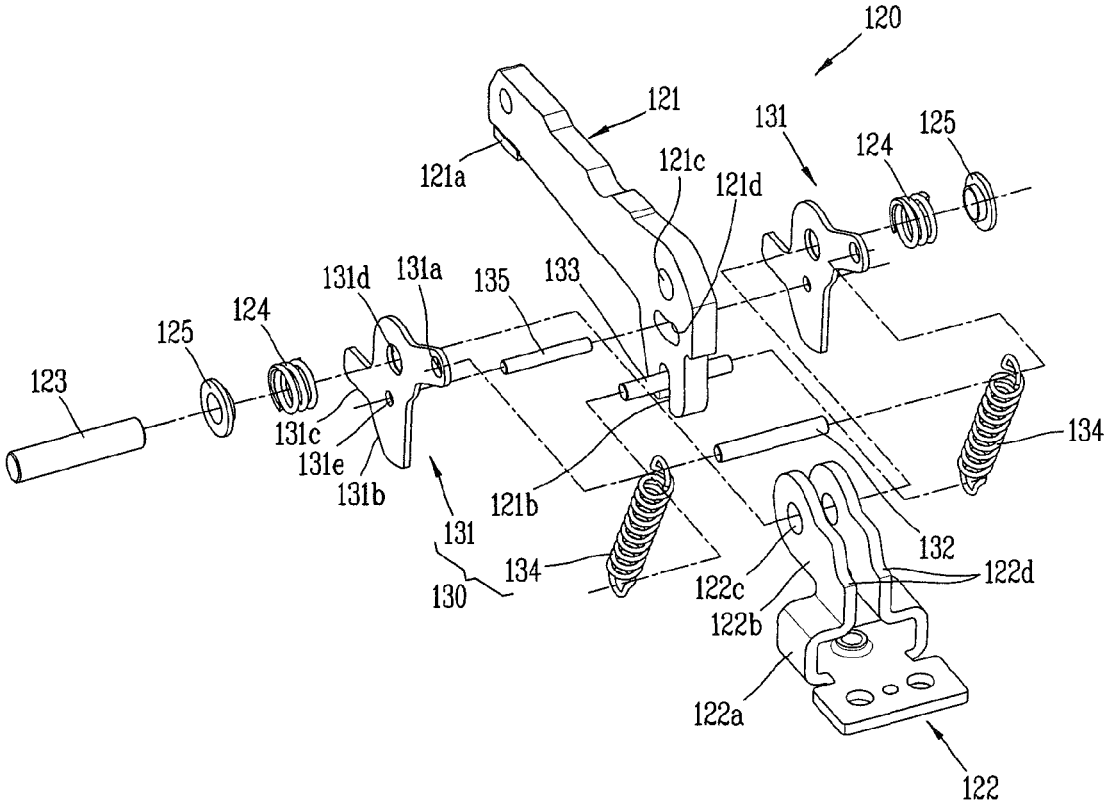
FIG. 9 is a disassembled perspective view of the shaft assembly of FIG. 8.

FIG. 7 is a sectional view of a circuit breaker having a shaft assembly according to the present invention, FIG. 8 is a perspective view of the shaft assembly of FIG. 7, and FIG. 9 is a disassembled perspective view of the shaft assembly of FIG. 8.

As shown, a circuit breaker having a shaft assembly according to the present invention comprises a trip unit 101 configured to detect an accident current, a switching mechanism 102 configured to separate a moveable contact 121*a* from a fixed contact 5*a* by receiving a signal indicating the occurrence of an accident current from the trip unit 101, and a shaft assembly 103 closed or tripped by the switching mechanism 102.

The shaft assembly 103 includes a plurality of shafts 110, a moveable plate unit 120 having the moveable contact 121*a* detachably mounted to the fixed contact 5*a* fixed to the circuit breaker, and rotatably coupled to the plurality of shafts 110, and a latch unit 130 coupled to the moveable plate unit 120 so that the moveable plate unit 120 can maintain a closed or tripped status.

The moveable plate unit 120 consists of a moveable plate 121 having the moveable contact 121*a* at one end thereof, a connecting plate 122 fixedly-coupled to the shaft 110 and having the moveable plate 121 rotatably coupled thereto, a connecting pin 123 forcibly inserted into the shaft 110 by penetratingly-coupling the moveable plate 121 and the connecting plate 122 to each other, connecting springs 124 disposed on outer surfaces of two sides of a latching plate 131 to be later explained, and configured to generate a contact pressure by pushing the latching plate 131, the connecting plate 122, and the moveable plate 121 from two sides, and washers 125 configured to prevent separation of the connecting springs 124.

The moveable plate 121 is formed in a '¬' shape, and the moveable contact 121*a* is coupled to one end of the moveable plate 121 by welding. To another end of the moveable contact 121*a*, a sliding recess 121*b* having a slit shape so as to couple a second latching pin 133 to be later explained thereto is formed in a direction of a pin hole to be later explained. A pin hole 121*c* for passing the connecting pin 123 therethrough is formed at an intermediate portion of the moveable plate 121, i.e., at a bent portion between two ends. A limit hole 121*d* having a circular arc shape and configured to restrict a relative motion of the latching plate 131 with respect to the moveable plate 121 is formed at one side of the pin hole 121*c*.

A body portion 122*a* of the connecting plate 122 is insertion-fixed to the shaft 110, and a coupling portion 122*b* having a 'U' shape is formed at an upper end of the body portion 122*a* so that the moveable plate 121 can be rotatably inserted thereinto. A hinge hole 122*c* for passing the connecting pin 123 therethrough is formed at one end of the coupling portion 122*b*. At another end of the coupling portion 122*b*, a first stop surface 122*d* with a step are formed so as to restrict a rotation of the latching plate 131 by locking a first latching pin 132 to be later explained.

The latch unit 130 consists of a latching plate 131 disposed between the coupling portion 122*b* of the connecting plate 122 and the connecting spring 124 so as to plane-contact outer surfaces of two sides of the connecting plate 122, a first latching pin 132 coupled to the latching plate 131, a second latching pin 133 coupled to the sliding recess 121*b* of the moveable plate 121, and a plurality of latching springs 134 each having both ends coupled to the first latching pin 132 and the second latching pin 133, respectively, and configured to elastically support the moveable plate 121 so that the moveable plate 121 can maintain a closed status and a tripped status.

The latching plate 131 is formed in a non-linear shape having at least three protrusions, and a latching pin hole 131*a* for inserting the first latching pin 132 is formed on one protrusion. A cam surface 131*b* for slidably supporting the second latching pin 133 is formed on another protrusion linearly or in the form of a minute curved surface. A second stop surface with a step 131*c* protruding from the end of the cam surface 131*b* with a predetermined stagger angle is linearly formed on still another protrusion so as to restrict a sliding motion of the second latching pin 133. A pin through hole 131*d* for passing the connecting pin 123 therethrough is formed between two protrusions of the latching plate 131. A pin coupling hole 131*e* for coupling a limit pin 135 coupled to the limit hole 121*d* of the moveable plate 121 is formed at one side of the pin through hole 131*d*.

In a case that the sliding recess 121*b* of the moveable plate 121 is formed in a direction of the pin hole, the latching pin hole 131*a* of the latching plate 131 is preferably positioned farther than the pin through hole 131*d* based on the moveable contact 121*a*. The reason is because the moveable plate 121 can be moved by a proper electromagnetic contact force.

The plurality of latching springs 134 are implemented as tensile type coil springs each having a predetermined tensile force. As aforementioned, each of the latching springs 134 has both ends fixedly-coupled to the first latching pin 132 and the second latching pin 133, respectively.

Assembly processes of the shaft assembly of the circuit breaker according to the present invention will be explained as follows.

Firstly, the connecting plate 122 is assembled to the moveable plate 121. Then, the connecting pin 123 is insertion-fixed to the connecting plate 122, and the latching plate 131 is inserted to two sides of the connecting pin 123. Then, the connecting springs 124 and the washers 125 are inserted into the connecting pin 123 from two side surfaces of the latching plate 131, respectively.

Then, the assembled moveable plate 121 is inserted into the shaft 110, thereby forcibly inserting the latching plate 131 into a recess (not shown) of the shaft 110. Under this state, the first latching pin 132 is inserted into the latching pin hole 131*a* of the latching plate 131, thereby assembling the two latching plates 131. The second latching pin 133 is assembled to the sliding recess 121*b* of the moveable plate 121, and two ends of each latching spring 134 are assembled to the first latching pin 132 and the second latching pin 133, respectively.

The shaft assembly according to the present invention has the following effects.

Figure 10:
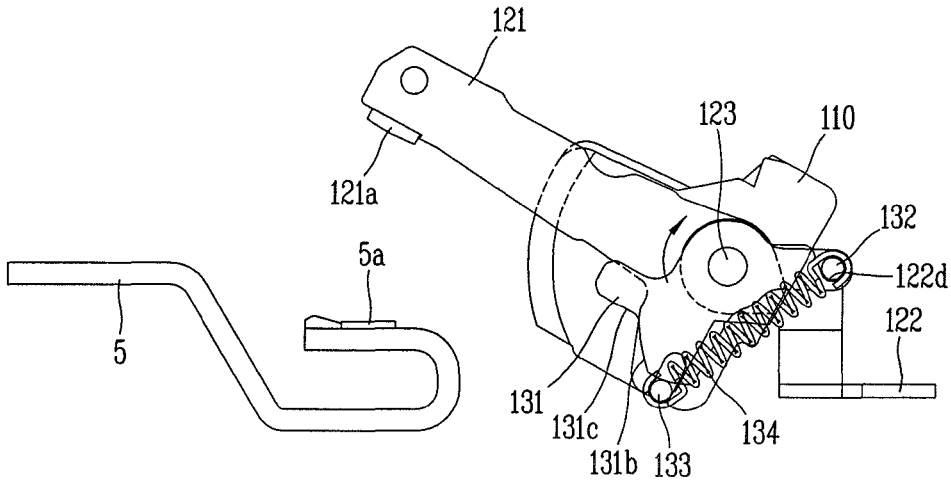
FIGS. 10 to 12 are schematic views showing operations of the shaft assembly according to each status according to the present invention.
Figure 11:
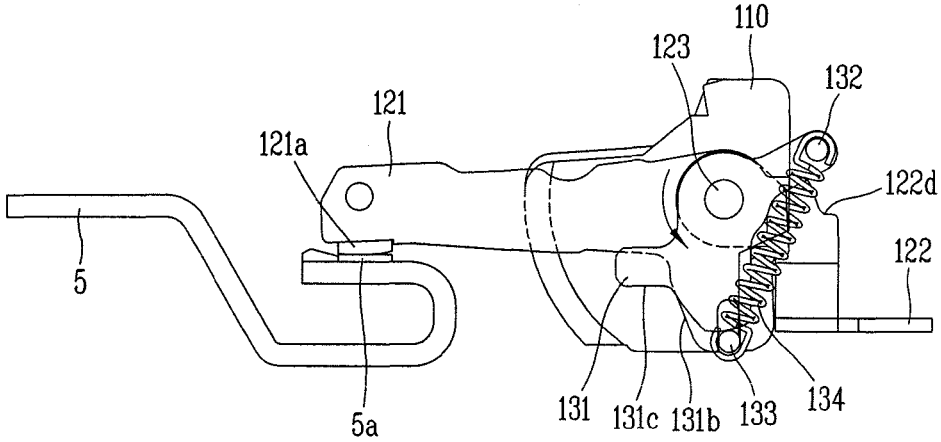
Figure 12:
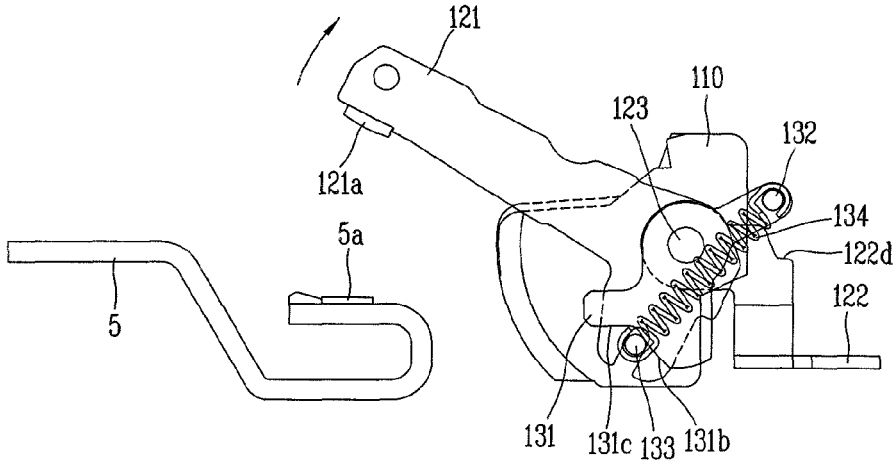

Firstly, when the circuit breaker is in a tripped status, the moveable plate 121 and the latching plate 131 are integrally coupled to the shaft t110 by the connecting pin 123 as shown in FIG. 10. As a result, the moveable plate 121 is rotated along a rotation direction of the shaft 110, thereby causing the moveable contact 121*a* to be separated from the fixed contact 5*a*. Here, the first latching pin 132 and the second latching pin 133 are assembled to the latching pin hole 131*a* of the latching plate 131 and the sliding recess 121*b* of the moveable plate 121, respectively. And, a tensile force of the latching springs 134 is transmitted to the moveable plate 121 through the latching plate 131. As a result, the moveable plate 121 maintains an 'OFF' status. The first latching pin 132 is locked by the first stop surface 122*d* of the connecting plate 122, thereby preventing excessive rotations of the latching plate 131.

When the circuit breaker is in an 'ON' status, the moveable plate 121 is rotated, by the switching mechanism 102, in a direction opposite to that of the tripped status along a rotation direction of the shaft 121. As a result, the moveable contact 121*a* comes in contact with the fixed contact 5*a*. Here, the tensile force of the latching springs 134 is transmitted to the latching plate 131, and thus a forward rotation force is transmitted to the moveable plate 121. Accordingly, a constant contact pressure is generated between the fixed contact 5*a* and the moveable contact 121*a*.

In the occurrence of an accident current, a contact repulsive force is generated between the fixed contact 5*a* of the fixed plate 5 and the moveable contact 121*a* of the moveable plate 121. As a result, the moveable plate 121 is lifted up. Here, the second latching pin 133 moves along the cam surface 131*b* of the latching plate 131. While moving, the second latching pin 133 is locked by the second stop surface 131*c* between the cam surface 131*b* and the second stop surface 131*c*, thereby restricting a rotation of the moveable plate 121. A backward rotation force is transmitted to the latching plate 131 by the tensile force of the latching springs 134, and the latching plate 131 transmits the backward rotation force to the moveable plate 121. As a result, the moveable plate 121 maintains a lifted status.

Figure 13:
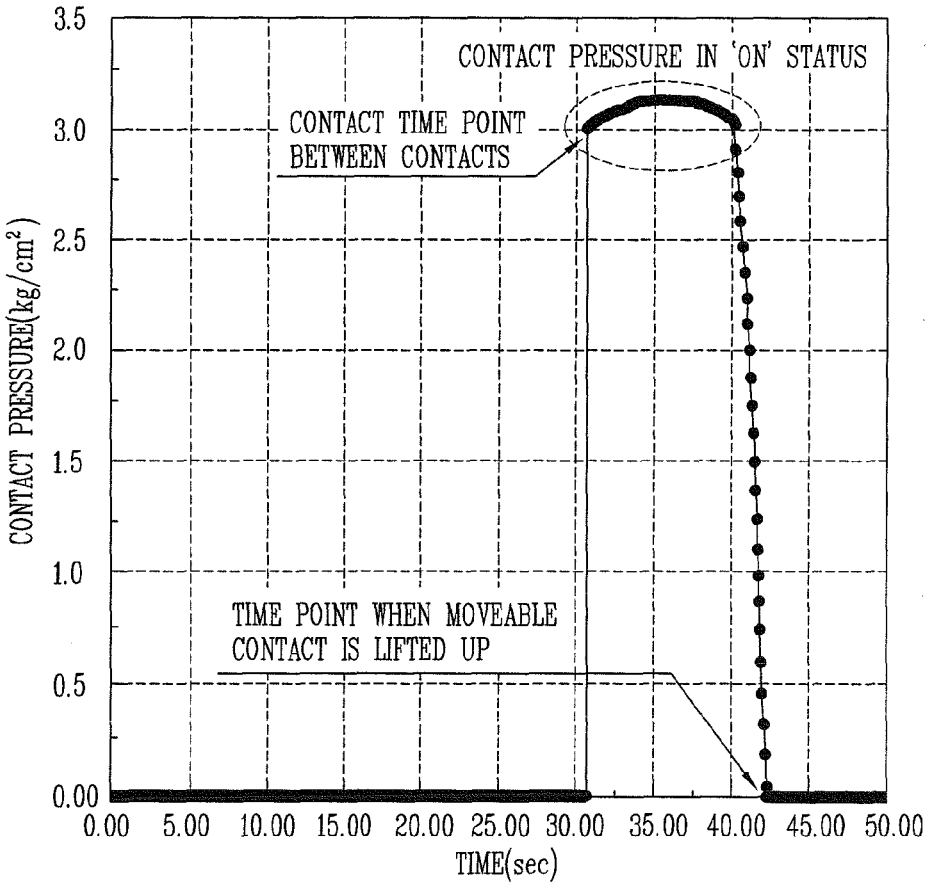
FIG. 13 is a graph showing changes of a contact pressure generated between a fixed contact and a moveable contact in FIGS. 10 to 12.

When the circuit breaker is in a tripped status, a closed status and an accident current status consecutively, a contact pressure generated between the fixed contact 5*a* of the fixed plate 5 and the moveable contact 121*a* of the moveable plate 121 is shown in FIG. 13. The numerical values shown in FIG. 13 are not absolute values, but relative values for comparison with the conventional values. The horizontal axis indicates time, and the vertical axis indicates a contact pressure.

It takes about 11 seconds for the moveable contact 121*a* to be lifted up from a time point when the fixed contact 5*a* and the moveable contact 121*a* come in contact with each other. A contact pressure when the circuit breaker is in an 'ON' status is 3.0. This means that the time taken for the moveable contact 121 to be lifted up is shortened more than the conventional time (17 seconds) by 35%, approximately, and the contact pressure (3.0) is maintained more constantly than in the conventional art.

In the circuit breaker according to the present invention, time taken for the moveable contact to be lifted up from the time point when the fixed contact 5*a* and the moveable contact 121*a* come in contact with each other is shortened. This may reduce a time duration for which an accident current flows. Accordingly, the amount of energy applied to the circuit breaker may be reduced, and a breaking function of the circuit breaker may be enhanced.

Furthermore, the cam surface of the latching plate is almost linearly formed based on an inflection point. Accordingly, the contact pressure between the moveable contact and the fixed contact has a constant change after the inflection point. This may enhance a reliability on a conductive state of the moveable contact and the fixed contact.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker, comprising:

a trip unit configured to detect an accident current;

a switching mechanism configured to separate a moveable contact from a fixed contact in response to receiving a signal from the trip unit that indicates occurrence of the accident current;

a shaft configured to be rotated by the switching mechanism;

a connecting plate fixedly-coupled to the shaft;

a moveable plate rotatably coupled to the connecting plate and comprising the moveable contact that is configured to contact or separate from the fixed contact;

a latching plate rotatably coupled to the moveable plate; and a latching spring formed as an elastic spring having one end fixed to the latching plate and another end fixed to the movable plate and configured to receive an elastic force in a direction that the moveable contact is spaced from the fixed contact, wherein a sliding recess is formed at the moveable plate and a cam surface is formed at the latching plate in order to implement a different opened degree of the sliding recess when the latching plate is rotated, and wherein a first latching in for fixing the one end of the latching spring is coupled to one end of the latching plate and a second latching in for fixing the another end of the latching spring is inserted into the sliding recess such that the latching spring is slidably coupled to the cam surface of the latching plate.

2. The circuit breaker of claim 1, wherein the sliding recess is formed on an outer circumferential surface of the moveable plate in a direction of a rotation center of the moveable plate.

3. The circuit breaker of claim 1, wherein the cam surface of the latching plate is nearly linearly formed.

4. The circuit breaker of claim 1, wherein:

a latching pin hole for inserting the first latching pin is formed at the latching plate; and the latching pin hole is positioned farther than a rotation center of the moveable plate based on the moveable contact.

5. The circuit breaker of claim 4, wherein:

a first stop surface is formed at the connecting plate and configured to restrict rotation of the latching plate; and the first latching pin is mounted on the first stop surface.

6. The circuit breaker of claim 5, wherein:

a second stop surface is formed at the latching plate and configured to restrict rotation of the moveable plate; and the second latching pin is mounted on the second stop surface.

7. The circuit breaker of claim 1, wherein:

the moveable plate further comprises a limit hole having a circular arc shape; and a limit pin is coupled to the latching plate and slidably coupled to the limit hole of the moveable plate in order to restrict relative motion between the latching plate and the moveable plate.

8. A circuit breaker, comprising:

a trip unit configured to detect an accident current;

a switching mechanism configured to separate a moveable contact from a fixed contact in response to receiving a signal from the trip unit that indicates occurrence of the accident current;

a shaft configured to be rotated by the switching mechanism;

a moveable plate rotatably coupled to the shaft and comprising the moveable contact that is configured to contact or separate from the fixed contact;

a latching plate rotatably coupled to the moveable plate; and a latching spring formed as an elastic spring having one end fixed to the latching plate and another end fixed to the movable plate and configured to receive an elastic force in a direction that the moveable contact is spaced from the fixed contact, wherein a first latching pin for fixing the one end of the latching spring is coupled to one end of the latching plate, wherein a second latching pin for fixing the another end of the latching spring is coupled to one end of the moveable plate, wherein a latching pin hole for inserting the first latching pin is formed at the latching plate, and wherein the latching pin hole is positioned farther than a rotation center of the moveable plate based on the moveable contact.

9. The circuit breaker of claim 8, wherein:

a sliding recess configured to slidably insert the second latching pin hole is formed at the moveable plate in a direction of the rotation center of the moveable plate; and a cam surface is formed at the latching plate in order to implement a different opened degree of the sliding recess when the latching plate is rotated.

10. The circuit breaker of claim 9, wherein a stop surface is formed at the latching plate and comprises a stagger angle from the cam surface such that the second latching pin is locked in order to restrict rotation of the moveable plate.

11. The circuit breaker of claim 10, wherein:

the shaft comprises a connecting plate configured to couple the moveable plate to the shaft; and a stop surface comprising a step for restricting rotation of the first latching pin is formed at the connecting plate.

* * * * *